US005984793A

United States Patent [19]

Palombi

[11] Patent Number: 5,984,793

[45] Date of Patent: Nov. 16, 1999

[54] GOLF GAME

[75] Inventor: Carlo A. Palombi, 64 Duran Dr., San Rafael, Calif. 94903

[73] Assignee: Carlo A. Palombi, San Rafael, Calif.

[21] Appl. No.: 08/916,968

[22] Filed: Aug. 19, 1997

Related U.S. Application Data

[60] Provisional application No. 60/026,281, Sep. 18, 1996.

[51] Int. Cl.[6] ..... A63B 69/36

[52] U.S. Cl. ..... 473/195; 473/193

[58] Field of Search ..... 473/172, 195, 473/193, 159, 194, 197

[56] References Cited

U.S. PATENT DOCUMENTS

| | | | |
|---|---|---|---|
| 1,719,240 | 7/1929 | Scanlan | 473/195 |
| 2,988,360 | 6/1961 | Lambiotte | 473/195 |
| 2,988,363 | 6/1961 | Hall | 473/195 |
| 3,202,429 | 8/1965 | Richman | 473/195 |
| 3,558,140 | 1/1971 | Romeo | 473/195 |
| 5,042,813 | 8/1991 | Huang | 473/172 |
| 5,549,302 | 8/1996 | Lapsker et al. | 473/193 |

OTHER PUBLICATIONS

Advertising leaflet for Chip–Off Challenge , from "Chip–Off Golf, Inc.", copyright 1997, one page.

*Primary Examiner*—Mark S. Graham
*Attorney, Agent, or Firm*—Kaardal Ass.; Ivar M. Kaardal; Vidya R. Bhakar

[57] ABSTRACT

A new golf game for practicing one's golf shots. The inventive device includes a game target used in association with a golf club and a game ball. The game target has a playing surface with a plurality of scoring regions provided on the surface. A scoring point value is assigned to each of the scoring region. The game is generally played by each player having a set of turns, each player taking alternating turns hitting a game ball with a golf club from a distance from the playing surface to strike a scoring region on the playing surface. The scoring point value of the scoring region the game ball first strikes is recorded and at the end of the set, the recorded scoring points of are totaled for each player respectively. The winning player is the player with the highest scoring point value total.

2 Claims, 4 Drawing Sheets

GOLF GAME

CROSS REFERENCE TO RELATED APPLICATION

This application claims the benefit of U.S. Provisional Application No. 60/026,281, filed Sep. 18, 1996.

BACKGROUND OF THE INVENTION

1. Field of the Invention

The present invention relates to golf game and more particularly pertains to a new golf game for practicing one's golf shots.

2. Description of the Prior Art

The use of golf game is known in the prior art. More specifically, golf game heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf game include U. S. Pat. No. 5,383,667; U.S. Pat. No. 4,743,026; U.S. Pat. No. Des. 266,010; U.S. Pat. No. 4,531,742; U.S. Pat. No. 4,531,742; and U.S. Pat. No. 4,171,134.

While these devices fulfill their respective, particular objectives and requirements, the aforementioned patents do not disclose a new golf game. The inventive device includes a game target used in association with a golf club and a game ball. The game target has a playing surface with a plurality of scoring regions provided on the surface. A scoring point value is assigned to each of the scoring region. The game is generally played by each player having a set of turns, each player taking alternating turns hitting a game ball with a golf club from a distance from the playing surface to strike a scoring region on the playing surface. The scoring point value of the scoring region the game ball first strikes is recorded and at the end of the set, the recorded scoring points of are totaled for each player respectively. The winning player is the player with the highest scoring point value total.

In these respects, the golf game according to the present invention substantially departs from the conventional concepts and designs of the prior art, and in so doing provides an apparatus primarily developed for the purpose of practicing one's golf shots.

SUMMARY OF THE INVENTION

In view of the foregoing disadvantages inherent in the known types of golf game now present in the prior art, the present invention provides a new golf game construction wherein the same can be utilized for practicing one's golf shots.

The general purpose of the present invention, which will be described subsequently in greater detail, is to provide a new golf game and method which has many of the advantages of the golf game mentioned heretofore and many novel features that result in a new golf game which is not anticipated, rendered obvious, suggested, or even implied by any of the prior art golf game, either alone or in any combination thereof.

To attain this, the present invention generally comprises a game target used in association with a golf club and a game ball. The game target has a playing surface with a plurality of scoring regions provided on the surface. A scoring point value is assigned to each of the scoring region. The game is generally played by each player having a set of turns, each player taking alternating turns hitting a game ball with a golf club from a distance from the playing surface to strike a scoring region on the playing surface. The scoring point value of the scoring region the game ball first strikes is recorded and at the end of the set, the recorded scoring points of are totaled for each player respectively. The winning player is the player with the highest scoring point value total.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf game and method which has many of the advantages of the golf game mentioned heretofore and many novel features that result in a new golf game which is not anticipated, rendered obvious, suggested, or even implied by any of the prior art golf game, either alone or in any combination thereof.

It is another object of the present invention to provide a new golf game which may be easily and efficiently manufactured and marketed.

It is a further object of the present invention to provide a new golf game which is of a durable and reliable construction.

An even further object of the present invention is to provide a new golf game which is susceptible of a low cost of manufacture with regard to both materials and labor, and which accordingly is then susceptible of low prices of sale to the consuming public, thereby making such golf game economically available to the buying public.

Still yet another object of the present invention is to provide a new golf game which provides in the apparatuses and methods of the prior art some of the advantages thereof, while simultaneously overcoming some of the disadvantages normally associated therewith.

Still another object of the present invention is to provide a new golf game for practicing one's golf shots.

Yet another object of the present invention is to provide a new golf game which includes a game target used in association with a golf club and a game ball. The game target has a playing surface with a plurality of scoring regions provided on the surface. A scoring point value is assigned to each of the scoring region. The game is generally played by each player having a set of turns, each player taking alternating turns hitting a game ball with a golf club from a distance from the playing surface to strike a scoring region on the playing surface. The scoring point value of the scoring region the game ball first strikes is recorded and at the end of the set, the recorded scoring points of are totaled for each player respectively. The winning player is the player with the highest scoring point value total.

Still yet another object of the present invention is to provide a new golf game that is fun to play.

Even still another object of the present invention is to provide a new golf game that help one practice their accuracy of the golf shots, including chip shots and putts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
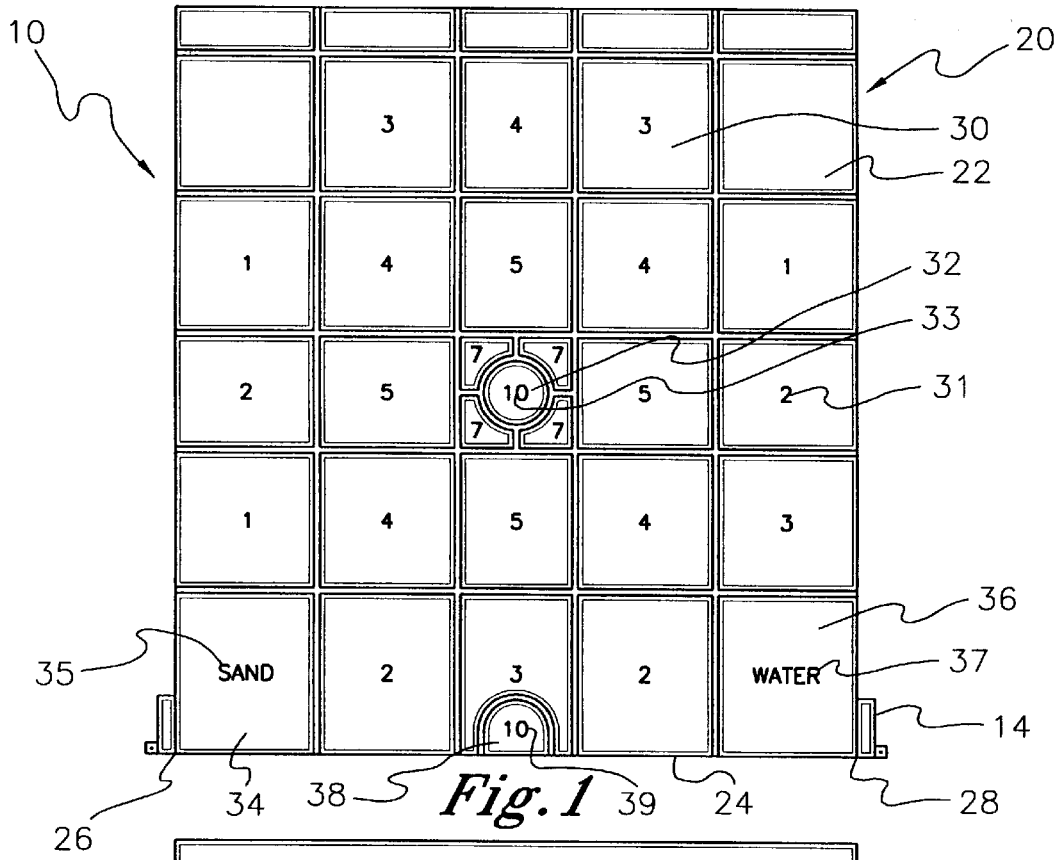
FIG. 1 is a front side view of a new golf game according to the present invention.
Figure 2:
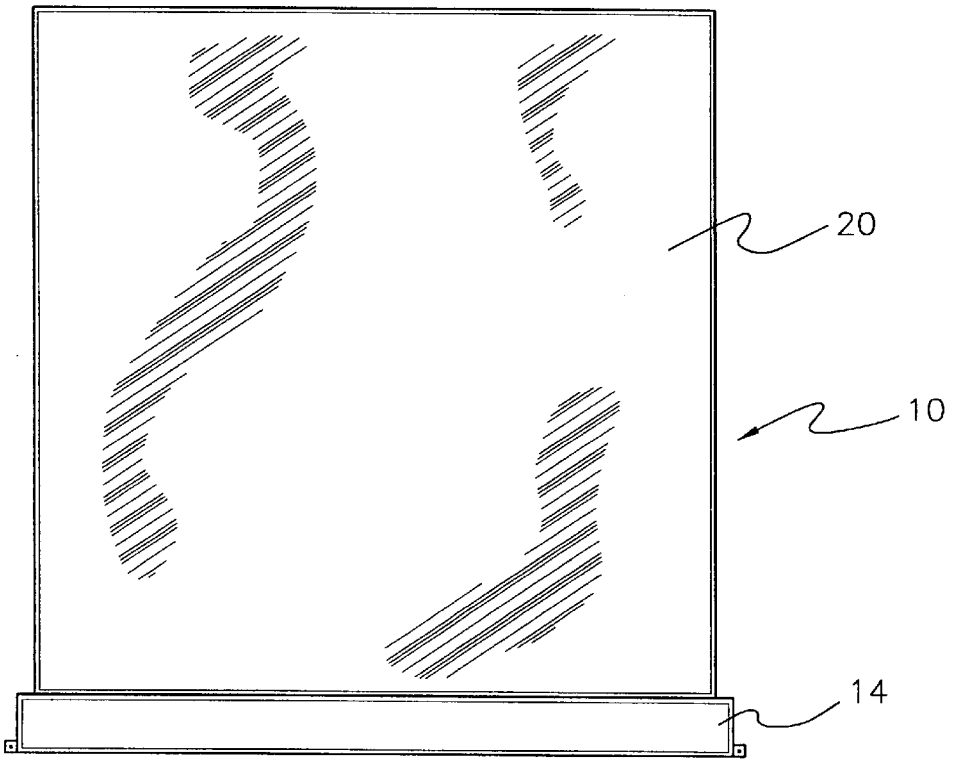
FIG. 2 is a rear side view of the present invention.
Figure 3:
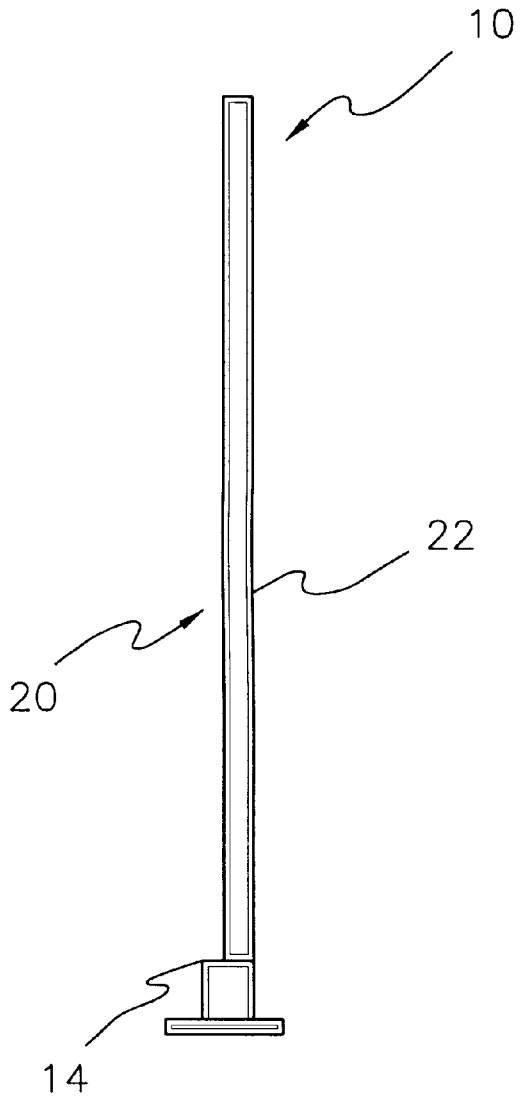
FIG. 3 is a side view of one side of the present invention.
Figure 4:
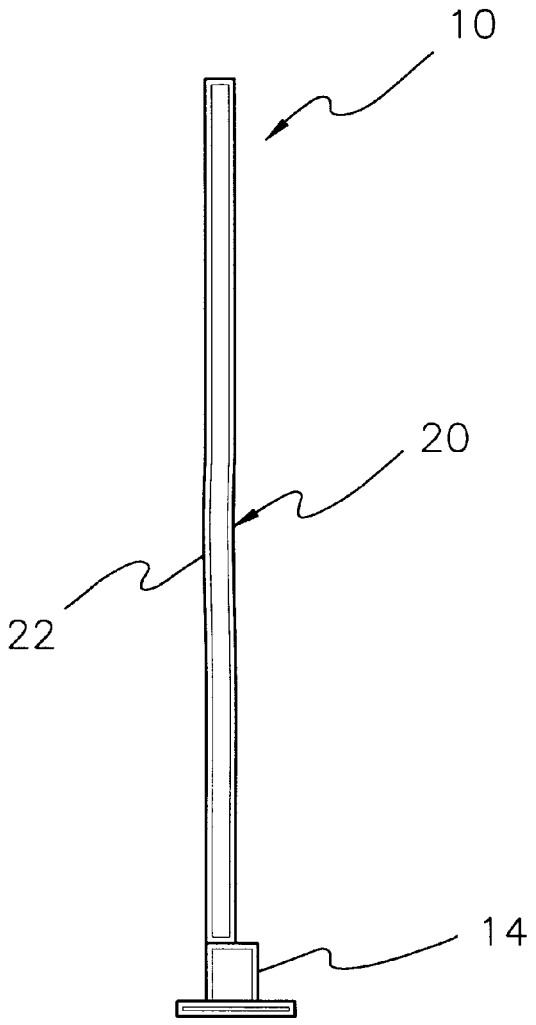
FIG. 4 is a side view of an other side of the present invention.
Figure 5:
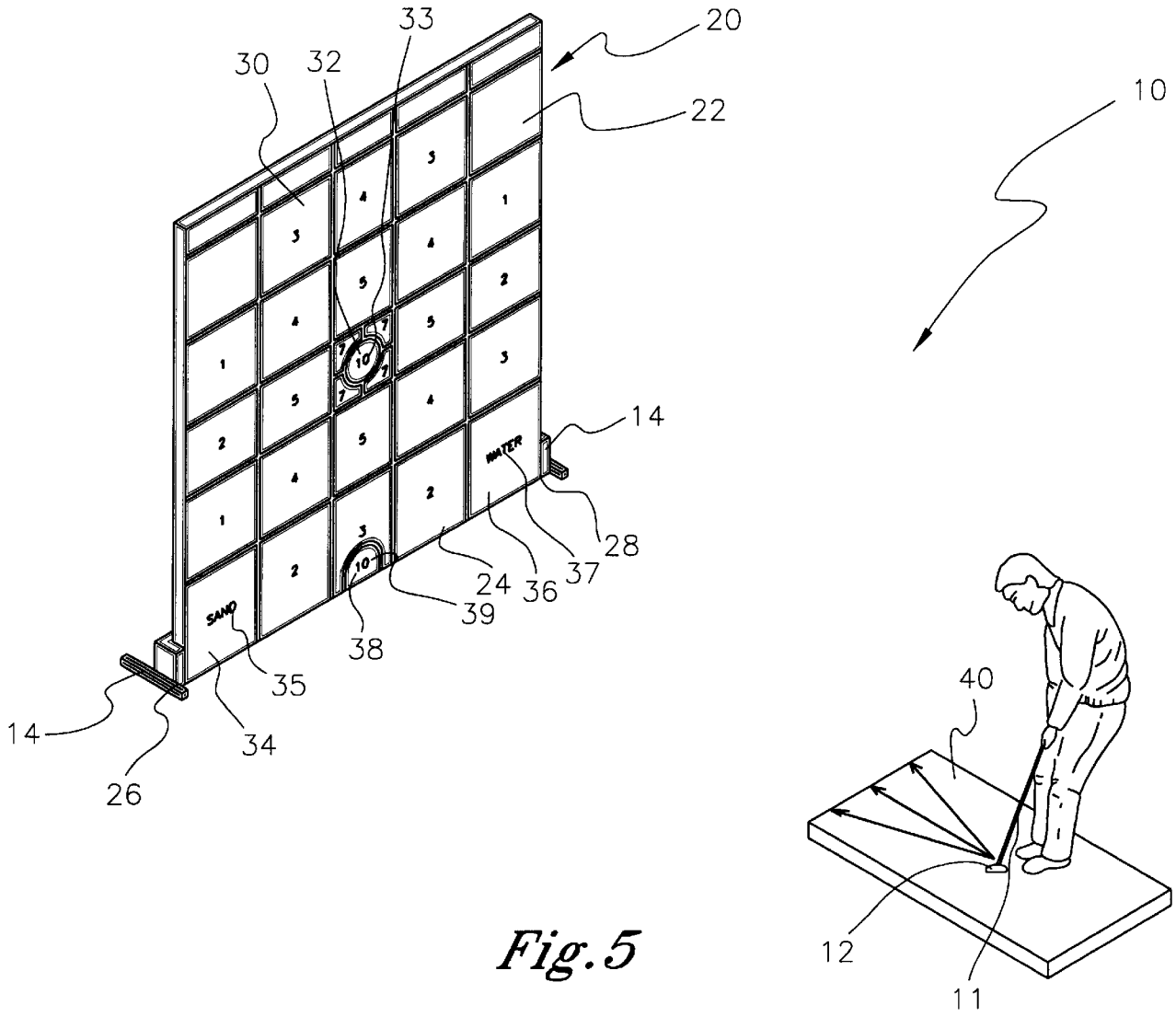
FIG. 5 is a perspective view of the present invention in use with a tee-off mat.

With reference now to the drawings, and in particular to FIGS. 1 through 6 thereof, a new golf game embodying the principles and concepts of the present invention and generally designated by the reference numeral 10 will be described.

As best illustrated in FIGS. 1 through 6, the golf game 10 generally comprises a game target 20 used in association with a golf club 11 and a game ball 12. The game target 20 has a playing surface 22 with a plurality of scoring regions 30 provided on the surface 22. A scoring point value is assigned to each of the scoring region 30. The game 10 is generally played by each player having a set of turns, each player taking alternating turns hitting a game ball with a golf club from a distance from the playing surface to strike a scoring region on the playing surface. The scoring point value of the scoring region the game ball first strikes is recorded and at the end of the set, the recorded scoring points of are totaled for each player respectively. The winning player is the player with the highest scoring point value total.

Preferably, the playing surface 22 is substantially planar. The scoring regions 30 are generally each assigned a scoring point value such that the scoring regions 30 positioned closer towards the central area of the playing surface 22 are assigned higher scoring point values than the scoring regions 30 positioned further away from the central area of the playing surface. Preferably, a highest scoring region 32 is provided on the playing surface positioned at the central area of the playing surface 22. The highest scoring region 32 is assigned a scoring point value higher than rest of the scoring regions 30 on the playing surface 22.

Preferably, a sand scoring region 34 and a water trap scoring region 36 are provided on the playing surface 22. Ideally, the sand trap scoring region 34 is positioned adjacent the lower edge 24 and the lower left corner 26 of the playing surface 22. Generally, the sand trap scoring region 34 is assigned a scoring point value less than the rest of the scoring regions 30. Preferably, a negative scoring point value is assigned to the sand trap scoring region 34. Ideally, the water trap scoring region is positioned adjacent the lower edge 24 and the lower right corner 28 of the playing surface 22.

As shown in FIG. 1, a putting scoring region 38 may be optionally provided on the playing surface 22. The putting scoring region is preferably positioned adjacent the lower edge 24 of the playing surface 22 at a midpoint between the lower left corner 26 and the lower right corner 28. The putting scoring region 38 may also optionally be assigned a scoring point value so that a strike of a game ball in the putting scoring can be totaled in a player's game set.

Preferably, indicia 31 are displayed on each of the scoring region 30 corresponding to the scoring point value assigned to each of the particular scoring regions 30. In particular, with reference to FIG. 1, it is preferred that the highest scoring region 32 has indicia 33 displayed on it indicating the scoring point value assigned to the highest scoring region 32.

Similarly, the sand trap scoring region 34 has the indicia "SAND" 35 being displayed on it to indicate the sand trap scoring region 34. Also similarly, the water trap scoring region 36 displays the indicia "WATER" 37 on it to indicate the water trap scoring region. It is also preferred that, when included on the invention, the putting scoring region 38 has indicia 39 on displayed on it indicating the scoring point value of the putting scoring region.

Figure 6:
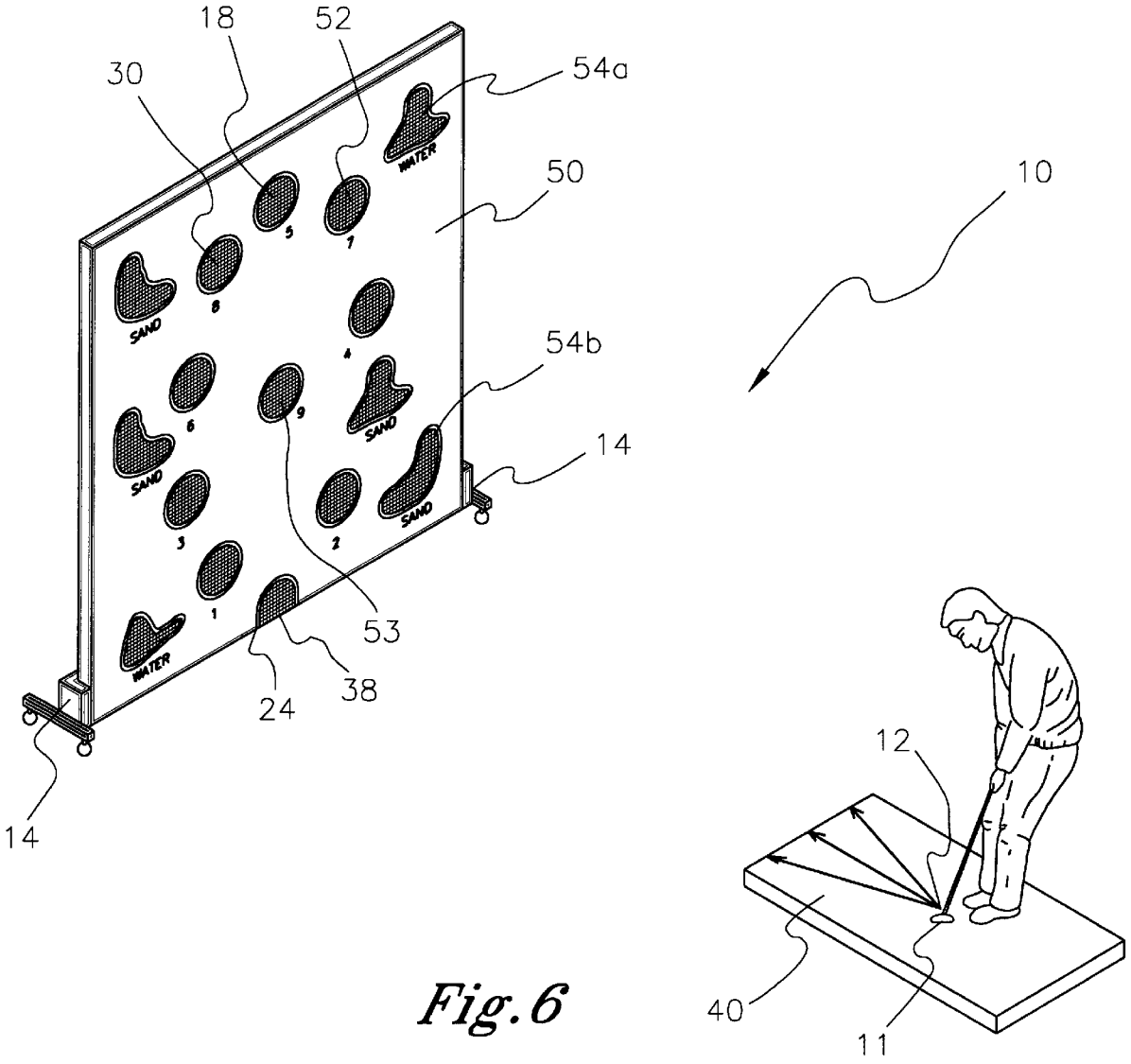
FIG. 6 is a perspective view of an optional embodiment of the present invention in use with a tee-off mat.

A support means 14 is included in the golf game 10 for supporting the game target 20 in a substantially upright on a ground surface. Preferably, the support means 14 is designed so that the lower edge 24 of the playing surface 22 is positioned adjacent the surface of the ground. Preferably, the support means 14 is designed to maintain the game target 20 in an upright position after a game ball 12 strikes the playing surface 22. As shown in FIG. 6, the support means may also include caster wheels to help maneuver the game target 20 along the ground.

Optionally, an attachment means (not shown) may be included in the invention for attaching a game ball 12 to the playing surface 22 when the game ball strikes the playing surface. A preferred embodiment of the attachment means (not shown) is a hooks and loops fastener where the hooks portion is provided on the game balls 12 and the loops portion being provided on the playing surface. The loops portion may cover the entire playing surface 22 or it may only cover the scoring regions 30 so that the game balls 12 only attach to the playing surface 22 when a game ball 12 strikes a scoring region 30. The loops portion may be made from some sort of carpeting such as the indoor/outdoor type commonly known as "Astroturf."

Also optionally, the game target may be constructed to include a retaining net (not shown) extending around the upper edge and later side edges of the playing surface 22. This retaining net would help keep game balls 12 which strike the playing surface 22 from rebounding too far from either side or above the playing surface 22.

In an other optional embodiment, as depicted in FIG. 6, each of the scoring regions may be constructed so that they comprise a hole extending through the playing surface 22 and a pouch 18 disposed in the hole for catching game balls passing through the hole.

Also optionally, the golf game 10 may include a tee-off mat 40. The tee-off mat 40 may be positioned at a distance from the playing surface 22 with the tee-off mat 40 facing the playing surface 22 so that the tee-off mat 40 provides a surface for hitting a game ball off of. An illustrative range of distance the tee-off mat 40 can be placed from the playing surface 22 is between 8 and 20 feet.

Preferably, the game ball 12 may be any type of ball suitable for striking with a golf club including regular golf balls or practice-type plastic golf balls.

The golf game 10 is played by each player having a set of 18 turns. Each player takes alternating turns hitting a game ball 12 with a golf club 11 from the tee-off mat 40 towards the playing surface 22. The players each record the scoring point value of the scoring region 30 their game ball 12 first strikes. As a special rule, when a player strikes the water trap scoring region 36, that player loses their following or next turn. Also, when a player strikes the sand trap scoring region a negative scoring point value is recorded for that turn. At the end of the 18 turn set, each player totals their recorded scoring points values of their respective set and the player with the highest scoring point value total wins the golf game.

As an optional embodiment of the golf game 10, with reference to FIG. 6, the playing surface 50 may be designed to have a plurality of spaced apart scoring regions each representing either a golf hole 52 or obstacle 54 on a golf course. As in the other embodiment of this invention, each scoring region 52, 54 has indicia displayed corresponding to the golf hole 53 or obstacle 54 assigned to each particular scoring region.

In particular, the scoring regions of this embodiment include a plurality of golf hole scoring regions 52, a highest golf hole scoring region 53, a plurality of spaced apart sand scoring regions 54*a*, and a plurality of spaced apart water trap scoring regions 54*b*. The plurality of golf hole scoring regions 52 are arranged on the playing surface 50 around the central area. The highest golf hole scoring region 53 is provided on the playing surface 22 positioned at the central area of the playing surface 22. Each the scoring regions or obstacle regions 54 has indicia indicating that particular scoring or obstacle region 52,54.

As in the other embodiment, a tee-off mat 40 may be included for hitting a game ball off of towards the playing surface 50.

In this embodiment of the golf game 10, the game is played by each player taking alternating turns hitting a game ball 12 with a golf club 11 from the tee-off mat 40 towards the playing surface 50. Each player should try to direct their game ball 12 at each golf hole scoring region 52 and the highest golf scoring hole 53 in a predetermined sequence. Generally this sequence is from lowest to highest scoring hole as in the game of golf. If a game ball scores a water trap scoring region or the sand trap region 54*a*, 54*b*, that player is required to miss the following turn. Similarly, when a game ball 12 scores a golf hole scoring region 52 out of the predetermined sequence, the player is also required to miss the following turn. The first player to successfully complete the predetermined sequence wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf game, comprising:

a game ball having a first portion of a hook and loop fastener provided thereon;

a game target having a generally rectangular and substantially planar playing surface, a substantially planar generally rectangular back face opposite said playing surface of said game target, and a generally rectangular outer perimeter comprising spaced apart and substantially parallel top and bottom edges and a pair of substantially parallel side edges extending between said top and bottom edges;

said playing surface having a central area, and a plurality of spaced apart scoring regions, said plurality of scoring regions including a first set of generally circular and generally equal sized golf hole scoring regions and a second set of obstacle scoring regions;

support means for supporting said game target substantially upright on a ground surface such that said lower edge of said playing surface is positioned adjacent the ground surface;

said support means comprising a generally rectangular elongate back member extending along said back face of said game target adjacent said bottom edge of said game target said support means further comprising a pair of generally rectangular side members coupled to said back member, said back member being interposed between said side members;

one of said side members being positioned adjacent one of said side edges of said game target adjacent said bottom edge of said game target and the other of said side members being positioned adjacent the other of said side edges of said game target adjacent said bottom edge of said game target;

said side members each having an elongate lower member coupled thereto, each of said lower members having a spaced apart pair of ground engaging caster wheels coupled thereto;

each scoring region having an outer periphery defining a boundary of an area of the respective scoring region on said playing surface;

said scoring regions each having a second portion of said hook and loop fastener substantially covering the area of the respective scoring region, said second portions of said hook and loop fastner being complementary to said first portion of said hook and loop fastener such that contact by said game ball with one of said scoring regions couples said first portion of said hook and loop fastener to the second portion of the hook and loop fastener of the contacted scoring region;

said playing surface having a remainder area in a boundary defined by said outer perimeter of said game target and excluding the areas of said scoring regions;

said remainder area of said playing surface comprising a generally smooth surface adapted for preventing attachment of said first portion of said hook and loop fastener of said game ball to said remainder area upon contact between said game ball and said remainder area;

each scoring region having indicia displayed thereon corresponding to the golf hole or obstacle assigned to said scoring region;

said first set of golf hole scoring regions being arranged on said playing surface in a generally circular in around said central area, each golf hole scoring region having indicia displayed thereadjacent indicating said golf hole scoring region;

said plurality of scoring regions further including a generally circular highest golf hole scoring region being provided on said playing surface, said highest scoring region being positioned at said central area, said highest golf hole scoring region having indicia being displayed thereadjacent indicating said highest golf hole scoring region;

said second set of obstacle scoring regions including a plurality of spaced apart sand scoring regions being provided on said playing surface, each said sand trap scoring region having indicia indicating "SAND" being displayed thereadjacent;

a first of sand scoring regions being positioned adjacent an upper left hand corner of said playing surface adjacent said top edge of said game target and one of said side edges of said game target;

a second of sand scoring regions being positioned adjacent said one side edge of said game target and below said first sand scoring region;

a third of sand scoring regions being positioned adjacent a lower right hand corner of said playing surface adjacent said bottom edge of said game target and said other of said side edges of said game target;

said second set of obstacle scoring regions including a plurality of spaced apart water trap scoring regions being provided on said playing surface, said water trap scoring region having indicia indicating "WATER" being displayed thereadjacent;

a first of water trap scoring regions being positioned adjacent a lower left hand corner of said playing surface adjacent said bottom edge of said game target and said one of said side edges of said game target and below said first and second sand scoring regions such that said second sand scoring region is located between said first sand scoring region and said first water trap scoring region on said playing surface;

a second of water trap scoring regions being positioned adjacent an upper right hand corner of said playing surface adjacent said top edge of said game target and the other of said side edges of said game target;

a fourth of sand scoring regions being positioned adjacent said other side edge of said game target and below said second water scoring region such that said fourth sand scoring region is located between said second water trap scoring region and said third sand scoring region on said playing surface;

wherein a game ball entering a water trap scoring region requires said player to miss the following turn;

said scoring regions further including a generally D-shaped putting scoring region, said putting scoring region being located on said playing surface adjacent said bottom edge of said game target;

said putting scoring region having an outer periphery comprising an arcuate upper portion and a substantially straight lower portion;

said upper portion of said putting scoring region having a concavity downwardly facing said bottom edge of said game target;

said lower portion of said putting scoring region being extended adjacent to and substantially parallel with said bottom edge of said game target;

a tee-off mat being positioned at a spaced apart distance from said playing surface;

said tee-off mat having a generally rectangular upper surface and a generally rectangular outer perimeter comprising a pair of substantially parallel short sides and a pair of substantially parallel long sides extending between said short aides of said upper surface of said tee-off mat;

a first of said short sides of said tee-off mat being positioned facing towards said playing surface of said game target;

said upper face of tee-off mat having three arrow indicia displayed thereon, each of said arrow indicia extending from a common point located between said short sides of said tee-off mat to said first short side of said tee-off mat;

each of said arrow indicia having an arrow head adjacent said first short side of said tee-off mat;

a middle arrow indicia of said three arrow indicia being extended substantially parallel to said long sides of said tee-off mat;

a first side arrow indicia of said three arrow indicia being extended in a direction at an acute angle away from said middle arrow towards a first of said long side edges of said tee-off mat;

a second side arrow indicia of said three arrow indicia being extended in a direction at an acute angle away from said middle arrow towards a second of said long side edges of said tee-off mat such that said middle arrow indicia is interposed between said first and second side arrow indicia;

wherein the game is played by each player taking alternating turns hitting a game ball with a golf club from the tee-off mat towards said playing surface, each player trying to direct their game ball at each golf hole scoring region and said highest golf scoring hole in a predetermined sequence, wherein a game ball entering a said golf hole out of the predetermine sequence requiring said player to miss the following turn wherein the first player to successfully complete the predetermined sequence winning the game.

2. A golf game, comprising:

a game ball having a first portion of a hook and loop fastener provided thereon;

a game target having a generally rectangular and substantially planar playing surface, a substantially planar generally rectangular back face opposite said playing surface of said game target, and a generally rectangular outer perimeter comprising spaced apart and substantially parallel top and bottom edges and a pair of substantially parallel side edges extending between said top and bottom edges;

said playing surface having a central area, and a plurality of spaced apart scoring regions, said plurality of scoring regions including a first set of generally circular and generally equal sized golf hole scoring regions and a second set of obstacle scoring regions;

support means for supporting said game target substantially upright on a ground surface such that said lower edge of said playing surface is positioned adjacent the ground surface;

said support means comprising a generally rectangular elongate back member extending along said back face of said game target adjacent said bottom edge of said game target;

said support means further comprising a pair of generally rectangular side members coupled to said back member, said back member being interposed between said side members;

one of said side members being positioned adjacent one of said side edges of said game target adjacent said bottom edge of said game target and the other of said side members being positioned adjacent the other of said side edges of said game target adjacent said bottom edge of said game target;

said side members each having an elongate lower member coupled thereto, each of said lower members having a spaced apart pair of ground engaging caster wheels coupled thereto;

each scoring region having an outer periphery defining a boundary of an area of the respective scoring region on said playing surface;

said scoring regions each having a second portion of said hook and loop fastener substantially covering the area of the respective scoring region, said second portions of said hook and loop fastner being complementary to said first portion of said hook and loop fastener such that contact by said game ball with one of said scoring regions couples said first portion of said hook and loop fastener to the second portion of the hook and loop fastener of the contacted scoring region;

said playing surface having a remainder area in a boundary defined by said outer perimeter of said game target and excluding the areas of said scoring regions;

said remainder area of said playing surface comprising a generally smooth surface adapted for preventing attachment of said first portion of said hook and loop fastener of said game ball to said remainder area upon contact between said game ball and said remainder area;

each scoring region having indicia displayed thereon corresponding to the golf hole or obstacle assigned to said scoring region; said first set of golf hole scoring regions being arranged on said playing surface in a generally circular ring around said central area, each golf hole scoring region having indicia displayed thereadjacent indicating said golf hole scoring region;

said plurality of scoring regions further including a generally circular highest golf hole scoring region being provided on said playing surface, said highest scoring region being positioned at said central area, said highest golf hole scoring region having indicia being displayed thereadjacent indicating said highest golf hole scoring region;

said second set of obstacle scoring regions including a plurality of spaced apart sand scoring regions being provided on said playing surface, each said sand trap scoring region having indicia indicating "SAND" being displayed thereadjacent;

a first of sand scoring regions being positioned adjacent an upper left hand corner of said playing surface adjacent said top edge of said game target and one of said side edges of said game target;

a second of sand scoring regions being positioned adjacent said one side edge of said game target and below said first sand scoring region;

a third of sand scoring regions being positioned adjacent a lower right hand corner of said playing surface adjacent said bottom edge of said game target and said other of said side edges of said game target;

said second set of obstacle scoring regions including a plurality of spaced apart water trap scoring regions being provided on said playing surface, said water trap scoring region having indicia indicating "WATER" being displayed thereadjacent;

a first of water trap scoring regions being positioned adjacent a lower left hand corner of said playing surface adjacent said bottom edge of said game target and said one of said side edges of said game target and below said first and second sand scoring regions such that said second sand scoring region is located between said first sand scoring region and said first water trap scoring region on said playing surface;

a second of water trap scoring regions being positioned adjacent an upper right hand corner of said playing surface adjacent said top edge of said game target and the other of said side edges of said game target;

a fourth of sand scoring regions being positioned adjacent said other side edge of said game target and below said second water scoring region such that said fourth sand scoring region is located between said second water trap scoring region and said third sand scoring region on said playing surface;

wherein a game ball entering a water trap scoring region requires said player to miss the following turn;

said scoring regions further including a generally D-shaped putting scoring region, said putting scoring region being located on said playing surface adjacent said bottom edge of said game target;

said putting scoring region having an outer periphery comprising an arcuate upper portion and a substantially straight lower portion;

said upper portion of said putting scoring region having a concavity downwardly facing said bottom edge of said game target;

said lower portion of said putting scoring region being extended adjacent to and substantially parallel with said bottom edge of said game target;

a tee-off mat being positioned at a spaced apart distance from said playing surface;

said tee-off mat having a generally rectangular upper surface and a generally rectangular outer perimeter comprising a pair of substantially parallel short sides and a pair of substantially parallel long sides extending between said short sides of said upper surface of said tee-off mat;

a first of said short sides of said tee-off mat being positioned facing towards said playing surface of said game target;

said upper face of tee-off mat having three arrow indicia displayed thereon, each of said arrow indicia extending from a common point located between said short sides of said tee-off mat to said first short side of said tee-off mat;

each of said arrow indicia having an arrow head adjacent said first short side of said tee-off mat;

a middle arrow indicia of said three arrow indicia being extended substantially parallel to said long sides of said tee-off mat;

a first side arrow indicia of said three arrow indicia being extended in a direction at an acute angle away from said middle arrow towards a first of said long side edges of said tee-off mat; and a second side arrow indicia of said three arrow indicia being extended in a direction at an acute angle away from said middle arrow towards a second of said long side edges of said tee-off mat such that said middle arrow indicia is interposed between said first and second side arrow indicia.

* * * * *